US008724430B2

(12) United States Patent
Hirano

(10) Patent No.: US 8,724,430 B2
(45) Date of Patent: May 13, 2014

(54) RETROGRADE DISPLAY MECHANISM AND TIMEPIECE HAVING THE SAME

(75) Inventor: Kei Hirano, Chiba (JP)

(73) Assignee: Seiko Instruments Inc. (JP)

( * ) Notice: Subject to any disclaimer, the term of this patent is extended or adjusted under 35 U.S.C. 154(b) by 222 days.

(21) Appl. No.: 13/417,431

(22) Filed: Mar. 12, 2012

(65) Prior Publication Data

US 2012/0236691 A1 Sep. 20, 2012

(30) Foreign Application Priority Data

Mar. 13, 2011 (JP) ..... 2011-054884

(51) Int. Cl.
*G04B 13/00* (2006.01)
*G04B 19/24* (2006.01)

(52) U.S. Cl.
USPC ..... 368/28; 368/80; 368/220

(58) Field of Classification Search
USPC ..... 368/28–40, 80, 220
See application file for complete search history.

(56) References Cited

U.S. PATENT DOCUMENTS

| | | | | |
|---|---|---|---|---|
| 7,215,602 | B2 * | 5/2007 | Hirano et al. | 368/28 |
| 7,443,768 | B2 * | 10/2008 | Watanabe et al. | 368/80 |
| 7,625,116 | B2 * | 12/2009 | Bron et al. | 368/101 |
| 7,961,560 | B2 * | 6/2011 | Hiraga et al. | 368/220 |
| 2006/0126436 | A1 | 6/2006 | Watanabe et al. | 368/28 |
| 2007/0201312 | A1 | 8/2007 | Watanabe | 368/37 |
| 2008/0106979 | A1 * | 5/2008 | Bron et al. | 368/34 |

* cited by examiner

*Primary Examiner* — Sean Kayes
(74) *Attorney, Agent, or Firm* — Adams & Wilks

(57) ABSTRACT

A retrograde display mechanism of a timepiece includes a retrograde display mechanism main body having a time value driving wheel that rotates once every day and that has a time value finger which advances a time value including a date or a day. A time value transmitting wheel has a time value transmitting wheel tooth portion and a drive cam portion which are rotated by one tooth every day by the time value finger. A fan-shaped wheel operating lever has a cam follower portion and a fan-shaped wheel operating tooth portion engaged with the drive cam portion, and a fan-shaped wheel and a fan-shaped wheel display portion which mesh with the fan-shaped wheel operating tooth portion to rotate in response to rocking of the operating lever. The fan-shaped wheel rapidly rotates reversely to return to an initial position whenever the end of the month or the end of the week passes.

20 Claims, 7 Drawing Sheets

RETROGRADE DISPLAY MECHANISM AND TIMEPIECE HAVING THE SAME

BACKGROUND OF THE INVENTION

1. Field of the Invention

The present invention relates to a retrograde display mechanism and a timepiece having the same.

2. Description of the Related Art

In the timepiece, the retrograde display mechanism is used when the tens position (second digit) of a date is displayed by a fan-like or fan-shaped display member in a type in which a date is displayed by a large character (hereinafter, referred to as "big date" type) or when a small hand (hereinafter, referred to as "small day hand") in the fan-like or fan-shaped display area rotates along the fan (JP-A-2007-218856 (Patent Reference 1) and JP-A-2006-170764 (Patent Reference 2)).

In the retrograde display mechanism, after the fan-like or fan-shaped member is gradually rotated in one direction, when the end of the month is shifted to the beginning of month or when the end of the week is shifted to the beginning of week, the fan-like or fan-shaped member is rapidly rotated reversely to return to an initial position. Therefore, when viewing as a whole, the retrograde display mechanism includes a cam surface of which a diameter increases along one rotation direction as in a spiral, and is provided with a drive cam having a transition surface falling from a spiral maximum diameter portion to a minimum diameter portion and an operating lever which is engaged with an engaged portion of the fan-like or fan-shaped member so as to be elastically pressed against the drive cam through a cam follower on one end side and gradually rotate the fan-like or fan-shaped member in one direction through the engagement portion on the other side. In this case, the operating lever enlarges the position of the cam surface to transmit the position to the engaged portion of the fan-like or fan-shaped member.

However, since there is a limit for the accuracy of the cam surface due to the cost, the position of the fan-like or fan-shaped member is deviated in response to the deviation from an appropriate position of the cam surface, the positions of date and the small day hand in the big date type are shifted, there is concern that the product may look less attractive or that high-class feeling or the like of the external appearance (look) of the product may deteriorate.

SUMMARY OF THE INVENTION

It is an aspect of the present application to provide a retrograde display mechanism and a timepiece having the same which can suppress the position deviation of display to the minimum.

According to the present application, there is provided a retrograde display mechanism including: a retrograde display mechanism main body having a time value driving wheel that has a time value driving tooth portion and time value finger which advance a time value including a date or a day and that rotates once every day, a time value transmitting wheel that has a time value transmitting wheel tooth portion and a drive cam portion which are rotated by one tooth every day by the time value finger of the time value driving wheel, a fan-shaped wheel operating lever that has a cam follower portion and a fan-shaped wheel operating tooth portion which are elastically pressed against the drive cam portion of the time value transmitting wheel to be engaged with the drive cam portion, and a fan-shaped wheel that has a fan-shaped wheel tooth portion and a fan-shaped wheel display portion which mesh with the fan-shaped wheel operating tooth portion of the fan-shaped wheel operating lever to rotate in response to the rocking of the fan-shaped wheel operating lever, in which the fan-shaped wheel rapidly rotates reversely to return to an initial position whenever passing the end of the month or the end of the week; a fan-shaped wheel jumper that jumps and stops the fan-shaped wheel tooth portion of the fan-shaped wheel; and setting releasing means that releases a setting set by the fan-shaped wheel jumper whenever passing the end of the month or the end of the week.

In the retrograde display mechanism of the present application, "the fan-shaped wheel jumper that jumps and stops the fan-shaped wheel tooth portion of the fan-shaped wheel" is provided in addition to the retrograde display mechanism main body. Therefore, since the fan-shaped wheel jumper accurately set the fan-shaped wheel tooth portion of the fan-shaped wheel to be in a predetermined rotation position, even when there is a limit for the accuracy of the cam surface of the drive cam portion, the fan-shaped wheel display portion can display a time value including a date or a day in an accurate position in a state where the display accuracy increases. Therefore, there is no concern that the product may look less attractive and that the high-class feeling or the like of the external appearance (look) of the product may deteriorate.

Here, typically, the cam surface of the drive cam portion displaces the fan-shaped wheel operating lever to be in a temporal position slightly before a final displacement position. The displacement from the temporal position to the final displacement position is performed by the fan-shaped wheel jumper. However, as long as the displacement from the temporal position to the final displacement position is performed by the fan-shaped wheel jumper, the cam surface of the drive cam portion, as desired, may displace the fan-shaped wheel operating lever the temporal position slightly before the final displacement position.

In addition, in the retrograde display mechanism according to the present application, "the setting releasing means that releases a setting set by the fan-shaped wheel jumper whenever the end of the month or the end of the week passes" is provided in addition to the retrograde display mechanism main body and the fan-shaped wheel jumper. Therefore, despite that the fan-shaped wheel tooth portion of the fan-shaped wheel is set by the fan-shaped wheel jumper, the setting set by the fan-shaped wheel jumper is released by the setting releasing means whenever the end of the month or the end of the week passes. Accordingly, the retrograde display operation "in which the fan-shaped wheel rapidly rotates reversely to return to the initial position whenever the end of the month or the end of the week passes" is not interfered with by the jumper.

That is, in the retrograde display mechanism according to the present application, "the fan-shaped wheel jumper that jumps and stops the fan-shaped wheel tooth portion of the fan-shaped wheel and the setting releasing means that releases a setting set by the fan-shaped wheel jumper whenever the end of the month or the end of the week passes" are provided in addition to the retrograde display mechanism main body. Therefore, the benefit from the retrograde display mechanism that the large display can be performed in a narrow area using the fan-pattern display and the resolution of the problem of the display position deviation inevitably accompanying with the conventional retrograde display mechanism (the resolution of the demerit of the retrograde display) can be realized at the same time.

In a typical retrograde display mechanism according to the present application, the time value includes a date, the time value driving wheel includes a date indicator driving wheel, the time value transmitting wheel includes a first date indicator which has a first date plate portion displaying the ones position (first digit) of a date, the fan-shaped wheel operating lever includes a second date indicator operating lever, the fan-shaped wheel includes a second date indicator displaying the tens position of a date, the fan-shaped wheel tooth portion includes a second date display wheel, and the fan-shaped wheel jumper includes a second date jumper. In this case, the retrograde display mechanism includes: a retrograde display mechanism main body having the date indicator driving wheel that has a date indicator driving wheel tooth portion and a date finger and rotates once every day, the first date indicator that has a first date indicator tooth portion and a drive cam portion which are rotated by one tooth every day by the date finger of the date indicator driving wheel, the second date indicator operating lever that has a cam follower portion and a second date indicator operating tooth portion which are elastically pressed against the drive cam portion of the first date indicator to be engaged with the drive cam portion, and the second date indicator that has a second date display wheel and a second date plate portion which mesh with the second date indicator operating tooth portion of the second date indicator operating lever to rotate in response to the rocking of the operating lever, in which the second date indicator rapidly rotates reversely to return to an initial position whenever the end of the month passes; the second date jumper that jumps and stops the second date display wheel of the second date indicator; and setting releasing means that releases a setting set by the second date jumper whenever the end of the month passes.

In this case, the retrograde display mechanism displays the tens position (second digit) of a date in a way of big date type and performs the retrograde display that the display returns to the initial position when the end of the month is shifted to the beginning of month. In the big date type retrograde display mechanism, the second date jumper as the fan-shaped wheel jumper sets the second date display wheel to be in an accurate position and displays the tens position (second digit) of a date in an accurate position. Therefore, there is no case that, due to the position deviation, the product may look less attractive and that the high-class feeling or the like of the external appearance (look) of the product may deteriorate. In addition, in the retrograde display mechanism, whenever the setting releasing means passes the end of the month (when the end of the month is shifted to the beginning of month), the setting set by the second date jumper is released. Accordingly, a predetermined retrograde operation of returning to the initial position whenever the end of the month passes is not interfered with.

In this kind of retrograde display mechanism, typically, the setting releasing means releases the setting set by the second date jumper whenever the first date indicator rotates by an amount corresponding to one day.

In this case, even when the first date indicator rotates once to pass the end of the month (when the end of the month is shifted to the beginning of month), the first date indicator rotates by the amount corresponding to one day. Therefore, the setting set by the second date jumper can be reliably released. However, as long as the setting set by the second date jumper can be released by the setting releasing means when the end of the month is shifted to the beginning of month, the releasing may not be performed every day.

In addition, the above-described retrograde display mechanism, for example, includes a first date jumper that jumps and stops the first date indicator tooth portion, wherein the first date jumper displaces the second date jumper so as to release the setting of the second date display wheel set by the second date jumper when the first date indicator rotates by the amount corresponding to one day to pass a tooth of the first date indicator tooth portion.

In this case, whenever the first date indicator rotates by the amount corresponding to one day, the first date jumper jumps in response to the rotation of the first date indicator so as to pass a tooth of the first date indicator tooth portion. In response to the rotation of the first date jumper during the jump, the first date jumper rotates the second date jumper to release the setting of the second date indicator set by the second date jumper. Accordingly, "the setting releasing means releases the setting set by the second date jumper whenever the first date indicator rotates by the amount corresponding to one day", which can make a desired operation perform. That is, in this case, since the second date jumper is displaced in response to the displacement of the first date jumper, the control thereof is easily and directly performed. Furthermore, in this case, even when the first date jumper is directly engaged with the second date jumper, a link member may be interposed between the first and second date jumpers, and the first and second date jumpers may be engaged with each other through the link member.

Instead, in the above-described retrograde display mechanism, for example, the second date jumper may include a first date indicator engagement portion engaged with the first date indicator tooth portion, and the second date jumper, when the first date indicator rotates by the amount corresponding to one day, may be displaced by the first date indicator engagement portion to release the setting of the second date display wheel.

In this case, whenever the first date indicator rotates by the amount corresponding to one day, the first date indicator engagement portion of the second date jumper is displaced and the second date jumper releases the setting of the second date display wheel. Accordingly, "the setting releasing means releases the setting set by the second date jumper whenever the first date indicator rotates by the amount corresponding to one day", which can make a desired operation perform. In this case, the setting can be released by a single member (second date jumper including the first date indicator engagement portion). As a result, the occupancy space can be suppressed to the minimum.

In another typical retrograde display mechanism according to the present application, the time value includes a day, the time value driving wheel includes a day indicator driving wheel, the time value transmitting wheel includes a day indicator transmitting wheel, the fan-shaped wheel operating lever includes a hammer, the fan-shaped wheel includes a small day indicator, the fan-shaped wheel tooth portion includes a small day indicator tooth portion, and the fan-shaped wheel jumper includes a small day jumper. In this case, the retrograde display mechanism includes: a retrograde display mechanism main body having the day indicator driving wheel that has a day indicator driving wheel tooth portion and a day finger and rotates once every day, a day transmitting wheel that has a day transmitting wheel tooth portion and a drive cam portion which are rotated by one tooth every day by the day finger of the day indicator driving wheel, the hammer that has a cam follower portion and a small day indicator operating tooth portion which are elastically pressed against the drive cam portion of the day transmitting wheel to be engaged with the drive cam portion, and the small day indicator that has a small day indicator tooth portion and a small day hand which mesh with the small day indicator operating tooth portion of the hammer to rotate in response to the rocking of the hammer, in which the small day indicator rapidly rotates reversely to return to an initial position whenever the end of the week passes; a small day jumper that jumps and stops the small day indicator tooth portion of the small day indicator; and setting releasing means that releases a setting set by the second day jumper whenever the end of the week passes.

In this case, in the retrograde display mechanism, a fan-pattern small day display (for example, from Sunday to Saturday (however, other arrangements may be employed, for example, from Monday to Sunday)), is performed using the small day hand, and when the end of the week passes, that is, when the end of the week (for example, Saturday) is shifted to the beginning of week (for example, Sunday), the retrograde display in which the display returns to the initial position is performed. In the small day hand type of retrograde display mechanism, the small day jumper as the fan-shaped wheel jumper sets the small day indicator tooth portion of the small day indicator to be in an accurate position and displays a day in an accurate position. Therefore, there is no case that, due to the position deviation, the product may look less attractive and that the high-class feeling or the like of the external appearance (look) of the product may deteriorate. In addition, in the retrograde display mechanism, whenever the setting releasing means passes the end of the month, the setting set by the small day jumper is released. Accordingly, a predetermined retrograde operation of returning to the initial position whenever the end of the week passes is not interfered with.

In this kind of retrograde display mechanism, typically, the setting releasing means releases the setting set by the small day jumper whenever the day transmitting wheel rotates by the amount corresponding one day.

In this case, even when the day transmitting wheel rotates by the amount corresponding to seven days to shift from the end of the week to the beginning of week, the day transmitting wheel rotates by the amount corresponding to one day. Therefore, the setting set by the small day jumper can be reliably released by the setting releasing means. However, as long as the setting set by the small day jumper can be released by the setting releasing means when the end of the week is shifted to the beginning of week, the releasing may not be performed every day.

In addition, the above-described retrograde display mechanism, for example, includes a day jumper that jumps and stops the day transmitting wheel tooth portion, wherein the day jumper displaces the small day jumper so as to release the setting of the small day indicator tooth portion set by the small day jumper when the day transmitting wheel rotates by the amount corresponding to one day to pass a tooth of the day transmitting wheel tooth portion.

In this case, whenever the day transmitting wheel rotates by the amount corresponding to one day, the day jumper jumps in response to the rotation of the day transmitting wheel so as to pass a tooth of the day transmitting wheel tooth portion. In response to the rotation of the day jumper during the jump, the day jumper rotates the small day jumper to release the setting of the small day indicator tooth portion set by the small day jumper. Accordingly, "the setting releasing means releases the setting set by the small day jumper whenever the day transmitting wheel rotates by the amount corresponding to one day", which can make a desired operation perform. That is, in this case, since the small day jumper is displaced in response to the displacement of the day jumper, the control thereof is easily and directly performed. Furthermore, in this case, even when the day jumper is directly engaged with the small day jumper, a link member may be interposed between the day jumper and the small day jumper, and the day jumper and the small day jumper may be engaged with each other through the link member.

Instead, in the above-described retrograde display mechanism, for example, the small day jumper includes a day transmitting wheel engagement portion engaged with the small day indicator tooth portion, and the small day jumper, when the day transmitting wheel tooth portion rotates by the amount corresponding to one day, is displaced by the day transmitting wheel engagement portion to release the setting of the small day indicator tooth portion.

In this case, whenever the day transmitting wheel tooth portion rotates by the amount corresponding one day, the day transmitting wheel engagement portion of the small day jumper is displaced and the small day jumper releases the setting of the small day indicator tooth portion. "The setting releasing means releases the setting set by the small day jumper whenever the day transmitting wheel rotates by the amount corresponding to one day", which can make a desired operation perform. In this case, the setting can be released by a single member (small day jumper including the day transmitting wheel engagement portion). As a result, the occupancy space can be suppressed to the minimum.

A timepiece according to the present application includes the above-described retrograde display mechanism. The timepiece may be a mechanical timepiece or an analog electronic timepiece.

DETAILED DESCRIPTION OF THE PREFERRED EMBODIMENTS

Figure 1:
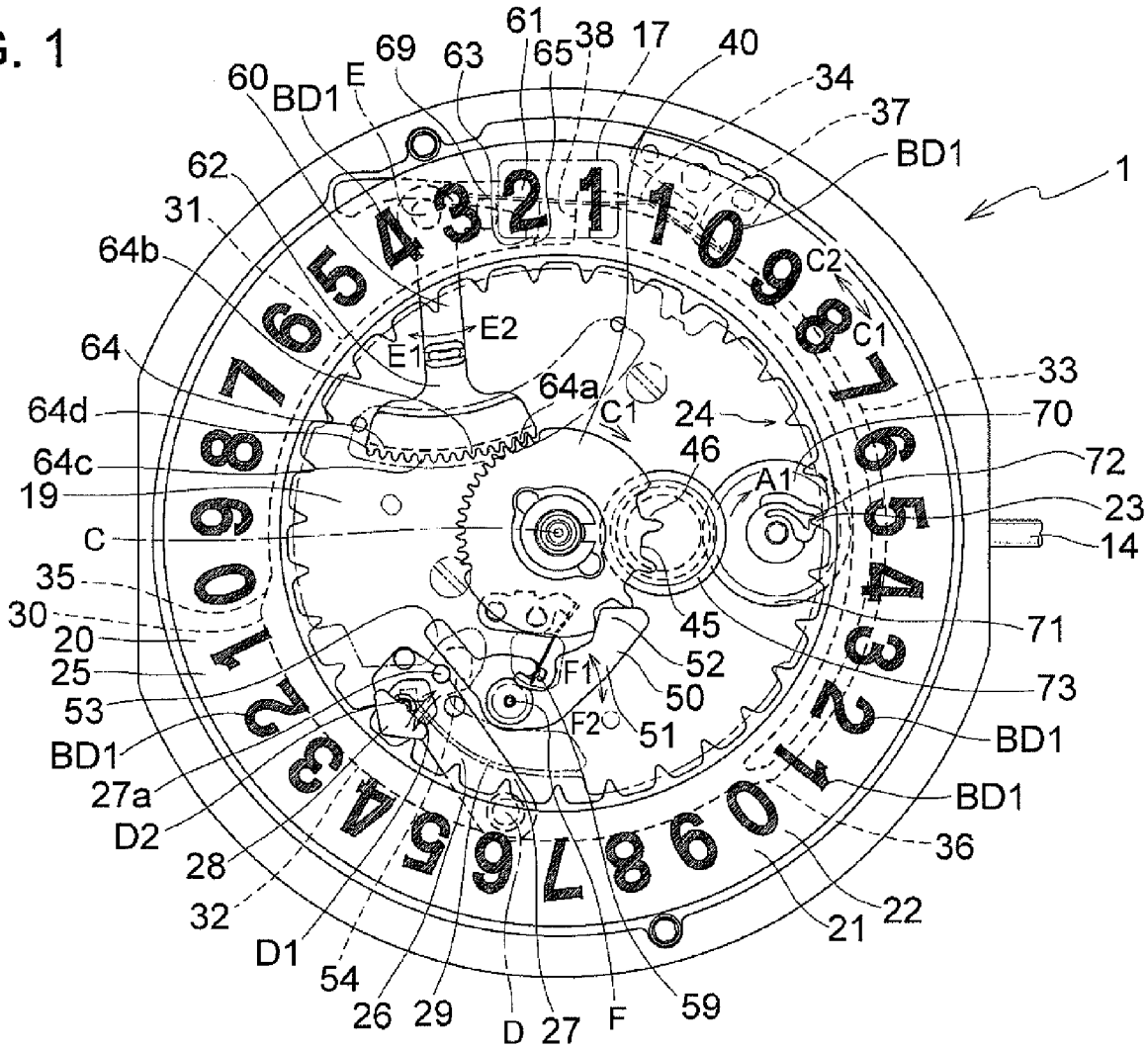
FIG. 1 is a plane diagram showing a part of timepiece according to a preferred embodiment of the present invention having a retrograde big date display mechanism as a retrograde display mechanism according to a preferred embodiment of the present invention (in a state where a second date indicator is excluded).

Preferred embodiments according to the present invention will be described with reference to the accompanying drawings showing preferred examples.

Embodiment

Before specifically describing a retrograde display mechanism according to a preferred embodiment of the present invention, the exterior appearance of a timepiece 7 according to the preferred embodiment of the present invention having a retrograde big date display mechanism 1 as the retrograde display mechanism will be approximately described with reference to FIG. 3.

The timepiece 7 is a wristwatch and includes an hour hand 11, a minute hand 12, and a second hand 13 which rotate about a center axis line C and a crown 15 at the protruding end of a winding stem 14. The timepiece 7 also includes a date window 17 at a position in approximately the 12 o'clock direction of a dial 16.

In the date window 17, a first date character BD1 ("1" in the same drawing) indicating the first digit or ones position of a date and a second date character BD2 ("0" in the same drawing) indicating the second digit or tens position of a date are displayed.

In the timepiece 7, the retrograde big date display mechanism 1 has a structure shown in FIG. 1. In the retrograde big date display mechanism 1, "a time value" is "a date". The retrograde display mechanism 1 includes a big date display mechanism in which the retrograde display of the tens position of a date is performed, that is, the retrograde big date display mechanism.

The retrograde big date display mechanism 1 as the retrograde display mechanism includes a first date indicator 20 as a time value transmitting wheel relating to the first digit (ones position) of a date and a second date indicator 40 (see FIGS. 1 and 2) as a fan-shaped wheel relating to the second digit (tens position).

As seen from FIG. 1, the first date indicator 20 includes an annular first date indicator main body portion 22 which has an annular first date display surface portion 21, a first date indicator tooth portion 24 which has 31 inner teeth 23 formed in the inner peripheral edge on the depth side (side close to the case back) of the first date indicator main body portion 22, and a drive cam portion 30 which is formed on the back surface side of an annular plate portion 25 of the first date indicator main body portion 22 and on the outer peripheral side of the first date indicator tooth portion 24.

As seen from FIG. 1, as the first date character BD1, nine dates from "1" to "9" corresponding to the "01st" to "09th" dates, ten dates from "0" to "9" corresponding to the "10th" to "19th" dates, ten dates from "0" to "9" corresponding to the "20th" to "29th" dates, and two dates from "0" and "1" corresponding to the "30th" to "31st" dates are attached to the first date display surface portion 21.

The drive cam portion 30 includes a first cam arc-like portion 31 forming a minimum diameter of arc and setting the "01st" to "09th" dates, a second cam arc-like portion 32 forming a second minimum diameter of arc and setting the "10th" to "19th" dates, a third cam arc-like portion 33 forming a third minimum diameter of arc and setting the "20th" to "29th" dates, and a fourth cam arc-like portion 34 forming a maximum diameter of arc and setting the "30th" to "31th" dates. The extensions of the second cam arc-like portion 32 and the third cam arc-like portion 33 in the peripheral direction (center angle when seen from the center axis line C) are the same in practice and five times the extension of the fourth cam arc-like portion 34 in the peripheral direction. The extension of the first cam arc-like (center angle when seen from the center axis line C) is slightly smaller (approximately 1/10) than the extensions of the second cam arc-like portion 32 and the third cam arc-like portion 33 in the peripheral direction (center angle when seen from the center axis line C). The first and second cam arc-like portions 31 and 32 are connected to a connection inclined surface 35 of which the diameter gradually increases. The second and third cam arc-like portions 32 and 33 are connected to a connection inclined surface 36 of which the diameter gradually increases. The third and fourth cam arc-like portions 33 and 34 are connected to a connection inclined surface 37 of which the diameter gradually increases. On the other hand, in order to perform the retrograde display, the fourth cam arc-like portion 34 and the first cam arc-like portion 31 are connected to a transition surface 38 which extends in approximately the radial direction such that the diameters thereof abruptly fall from the maximum diameter to the minimum diameter to return to the initial position. However, as long as the transition in the radial direction is allowed, there may be no surface in a partial or the entire transition surface 38.

The timepiece 7 includes a date indicator driving wheel 70 as a time value driving wheel, a first date jumper 26, and a first date jumper spring 29. The date indicator driving wheel 70 includes a date indicator tooth portion 71 and a date finger 72. The date indicator tooth portion 71 meshes with an hour indicator (not shown) through a transmitting wheel 73 so as to rotate in a A1 direction. The date finger 72 rotates once every day clockwise A1 in FIG. 1 in response to the rotation of the hour indicator (not shown) in a C1 direction. During the rotation in the A1 direction, the date finger 72 is engaged with the teeth 23 of the first date indicator tooth portion 24 to rotate the first date indicator tooth portion 24 in the C1 direction by one tooth.

The first date jumper 26 to which the first date jumper spring 29 applies the load of the spring in a D1 direction is mounted on a supporting substrate 19 such as a main plate so as to rotate about a center axis line D in the D1 and D2 directions, and includes a jumper main body 27 having a form of lever, a jump-and-stop claw portion 28 which jumps and stops the first date indicator tooth portion 24, and an engagement protrusion 27*a* which is located on the back surface side of the claw portion 28. The first date jumper 26 rotates in the D2 direction to perform the jump operation when the date unlocking through the date indicator driving wheel 70, that is, the rotation operation of the first date indicator tooth portion 24 in the C1 direction progresses. When the date unlocking ends, the first date jumper 26 rotates in the D1 direction to position the first date indicator tooth portion 24 at an intermittent rotation position and sets the rotation of the first date indicator tooth portion 24 under the action of the first jumper spring 29 until the next unlocking.

The retrograde big date display mechanism 1 as the retrograde display mechanism includes a second date indicator operating lever 60 as a fan-shaped wheel operating lever which connects the first date indicator 20 and the second date indicator 40. The second date indicator operating lever 60 can rotate about a center axis line E in E1 and E2 directions and receives the load of an operating lever spring 69 in the E1 direction.

The second date indicator operating lever 60 forms approximately an L-shape as a whole and includes two arm portions 61 and 62 forming the "L" shape. One arm portion 61 of the second date indicator operating lever 60 serves as a cam follower which is elastically pressed against the drive cam portion 30 of the first date indicator 20 in a forward end portion 63 under the action of the operating lever spring 69 to be engaged with the drive cam portion 30. The other arm portion 62 of the second date indicator operating lever 60 includes a second date indicator operating tooth portion 64 as a fan-shaped wheel operating tooth portion in a forward end portion.

On the "01st" to "09th" dates of each month, the forward end portion 63 of the cam follower 61 of the second date indicator operating lever 60 is engaged in practice with the first cam arc-like portion 31 of the drive cam 30 of the first date indicator 20 under the action of the operating lever spring 69, the lever portion or arm portion 62 of the second date indicator operating lever 60 is in a rotation position of rotating in the E1 direction to the maximum, and the second date indicator operating tooth portion 64 at the forward end of the arm portion 62, as shown in FIG. 1, is engaged with a tooth portion corresponding to the second date indicator 40 by a tooth 64*a* which is located on an end edge side in the E2 direction.

On the "10th" to "19th" dates of each month, the forward end portion 63 of the cam follower 61 of the second date indicator operating lever 60 is engaged in practice with the second cam arc-like portion 32 of the drive cam 30, the lever portion or arm portion 62 of the second date indicator operating lever 60 is in a rotation position of rotating in the E2 direction by one stage, and the second date indicator operating tooth portion 64 at the forward end of the arm portion 62 further rotates in the E2 direction to some extent from a position shown in FIG. 1 to be engaged with a tooth portion corresponding to the second date indicator 40 by a tooth 64*b* which is located at an area close to the end edge in the E2 direction.

In addition, on the "20th" to "29th" dates of each month, the forward end portion 63 of the cam follower 61 of the second date indicator operating lever 60 is engaged in practice with the third cam arc-like portion 33 of the drive cam 30, the lever portion or arm portion 62 of the second date indicator operating lever 60 is in a rotation position of further rotating in the E2 direction, and the second date indicator operating tooth portion 64 at the forward end of the arm portion 62 further rotates in the E2 direction to be engaged with a tooth portion corresponding to the second date indicator 40 by a tooth 64*c* which is located at an area relatively close to the end edge in the E1 direction.

Furthermore, on the "30th" to "31st" dates of each month, the forward end portion 63 of the cam follower 61 of the second date indicator operating lever 60 is engaged in practice with the fourth cam arc-like portion 34 of the drive cam 30, the lever portion or arm portion 62 of the second date indicator operating lever 60 is in a rotation position of rotating in the E2 direction to the maximum, and the second date indicator operating tooth portion 64 at the forward end of the arm portion 62 rotates in the E2 direction to the maximum to be engaged with a tooth portion corresponding to the second date indicator 40 by a tooth 64*d* which is located on the end edge side in the E1 direction.

Figure 2:
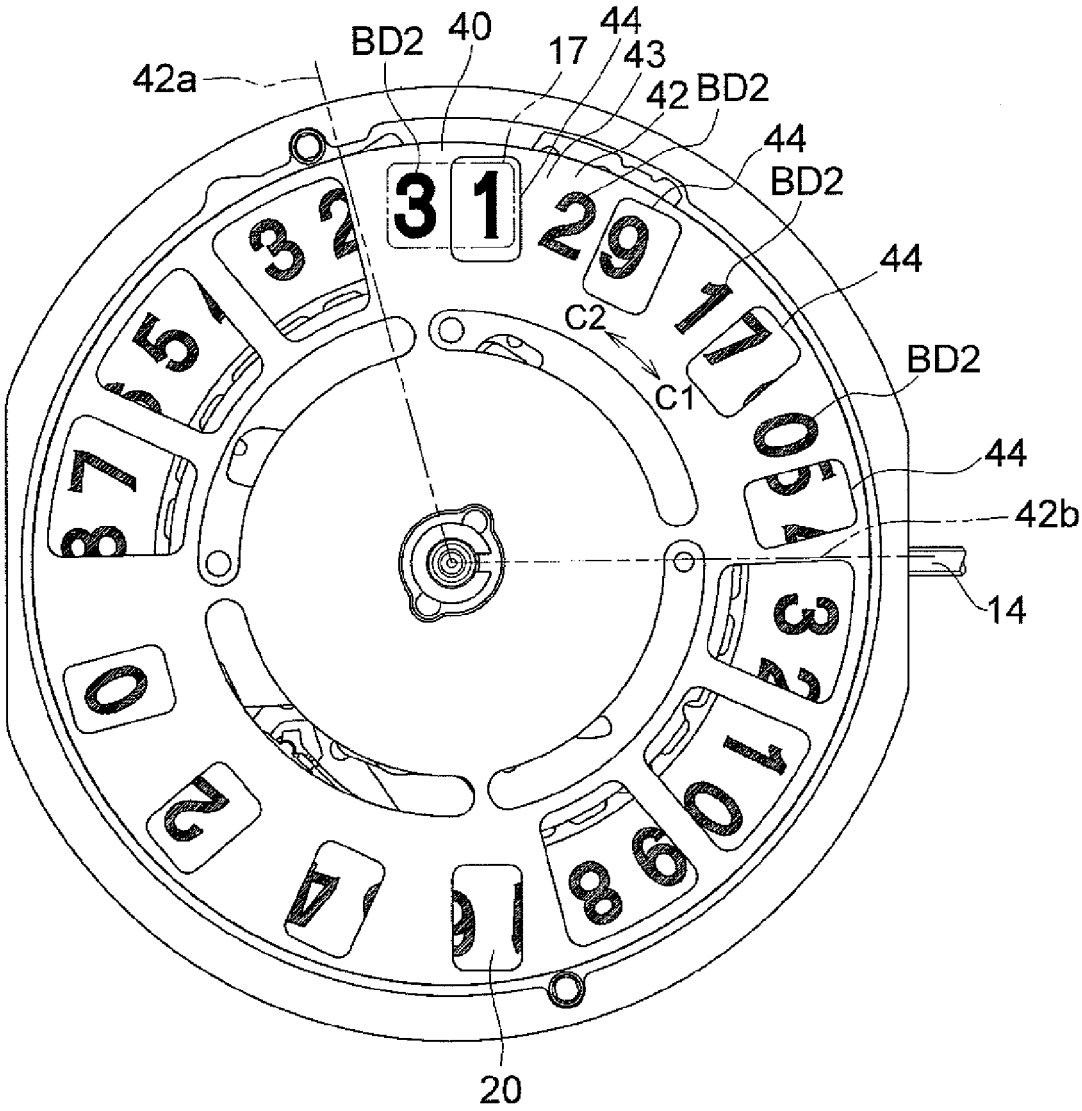
FIG. 2 is a plane diagram showing a state where a second date indicator overlaps in the timepiece shown in FIG. 1.

The second date indicator 40 as the fan-shaped wheel includes a second date indicator tooth portion 41 as a fan-shaped wheel tooth portion as shown in FIG. 1 and a second date plate portion 42 as a fan-shaped wheel display portion as shown in FIG. 2. The second date plate portion 42 is fixed to the second date indicator tooth portion 41 by caulking or the like. The range of the second date indicator 40 in which the second date indicator tooth portion 41 acts as a tooth portion is a fan-shaped range in which teeth are arranged in the arc-like shape in FIG. 1. The second date indicator tooth portion 41 functions as a fan-shaped tooth portion in practice.

As shown in FIG. 2, the second date plate portion 42 includes a second date display surface portion 43. To the second date display surface portion 43, as the second date character BD2, a date character "0" indicating the tens position (second digit) of a date between the "01st" to "09th" dates, a date character "1" indicating the tens position (second digit) of a date between the "10th" to "19th" dates, a date character "2" indicating the tens position (second digit) of a date between the "20th" to "29th" dates, and a date character "3" indicating the tens position (second digit) of a date between the "30th" and "31st" dates are attached. On the right side of each of the date characters BD2, a window 44 through which the ones position (first digit) of a date can be visually recognized is provided. A window frame of the window 44 is located outside the date window 17 of the dial 16 except for the left frame (left edge).

In addition, in the example shown in FIG. 2, the second date plate portion 42 has a circular plate shape. However, in FIG. 2, a practically functioning part of the second date plate portion 42 is a fan-shaped area between imaginary lines 42*a* and 42*b* which radically extend. Therefore, the second date plate portion 42 may be such a fan-like plate. For example, when the big date display is performed in the other position (for example, 6 o'clock position) instead of the 12 o'clock position, the lower left area in FIG. 2 is an optional area which can be used by displaying the characters "0", "1", "2", and "3" of the tens position (second digit) in a direction corresponding to the display position.

Referring to FIG. 1 again, the second date jumper 50 to which the second jumper spring 59 applies the spring load is attached to a main plate 19 so as to rotate about a center axis line F in F1 and F2 directions, and includes a second date jumper main body 51 as a form of lever, a jump-and-stop claw portion 52 which is formed on one side of the forward end of the second date jumper main body 51 and performs the jump operation of a second date indicator claw wheel portion 45 of the second date indicator tooth portion 41, and an interlocking arm portion 53 which extends from the peripheral edge portion of the center axis line F on a side approximately opposite to the second date jumper main body 51. The second date indicator claw wheel portion 45 includes plural claw portions 46. The range of the second date indicator 40 in which the second date indicator claw wheel portion 45 acts as the claw wheel portion is a fan-shaped area in which the claws 46 are arranged in the arc-like shape in FIG. 1. The second date indicator claw wheel portion 45 functions as a fan-like claw wheel in practice. In the example, the teeth, which are arranged in the arc-like shape, of the second date indicator tooth portion 41 as the fan-like tooth portion (fan-shaped tooth portion) and the claw portions 46, which are arranged in the arc-like shape, of the second date indicator claw wheel portion 45 as the fan-like claw wheel (fan-shaped claw wheel) are approximately positioned on the same circle, but may not be on the same circle as long as they can move together.

The interlocking arm portion 53 includes an engagement protrusion 54 at an area opposite to the engagement protrusion 27*a* of the first date jumper 26 in the vicinity of the forward end. When the first date jumper 26 rotates in the D2 direction to perform the jump operation, the engagement protrusion 54 of the second date jumper 50 is engaged with the engagement protrusion 27*a* of the first date jumper 26 to rotate in the F2 direction due to the engagement protrusion 27*a*, which releases the setting of the second date indicator tooth portion 41 (more specifically, the second date indicator claw wheel portion 45 thereof). That is, in the retrograde big date display mechanism 1 as the retrograde display mechanism, it is allowable that, whenever the first date jumper 26 releases the setting of the first date indicator tooth portion 24 in response to the date unlocking, the first date jumper 26 releases the setting of the second date indicator tooth portion 41 set by the second date jumper 50 during the releasing and thus the second date indicator tooth portion 41 freely rotates.

In addition, the first date jumper 26 does not interfere with the operation of the second date jumper 50 when the first date jumper 26 is set in the first date indicator tooth portion 24. That is, the second date jumper 50 performs the jump-and-stop operation for the rotation of the second date indicator tooth portion 41 due to the second date indicator operating tooth portion 64 of the second date indicator operating lever 60 except when the first date jumper 26 performs the jump operation of the first date indicator tooth portion 24.

In this example, setting releasing means which releases the setting set by the second date jumper 50 as the fan-shaped wheel jumper whenever the end of the month passes, includes the first date jumper 26. That is, the first date jumper 26 as engaging means is engaged with the engagement protrusion 54 of the second date jumper 50 by the engagement protrusion 27*a* thereof. In this case, the setting releasing means releases the setting set by the second date jumper 50 whenever the first date indicator 20 rotates by the amount corresponding to one day. Therefore, even when the end of the month passes (when the end of the month is shifted to the beginning of month), the setting set by the second date jumper 50 is released whenever the first date indicator 20 rotates by the amount corresponding to one day.

The operation of the retrograde big date display mechanism 1 of the timepiece 7 configured as above will be described.

Figure 3:
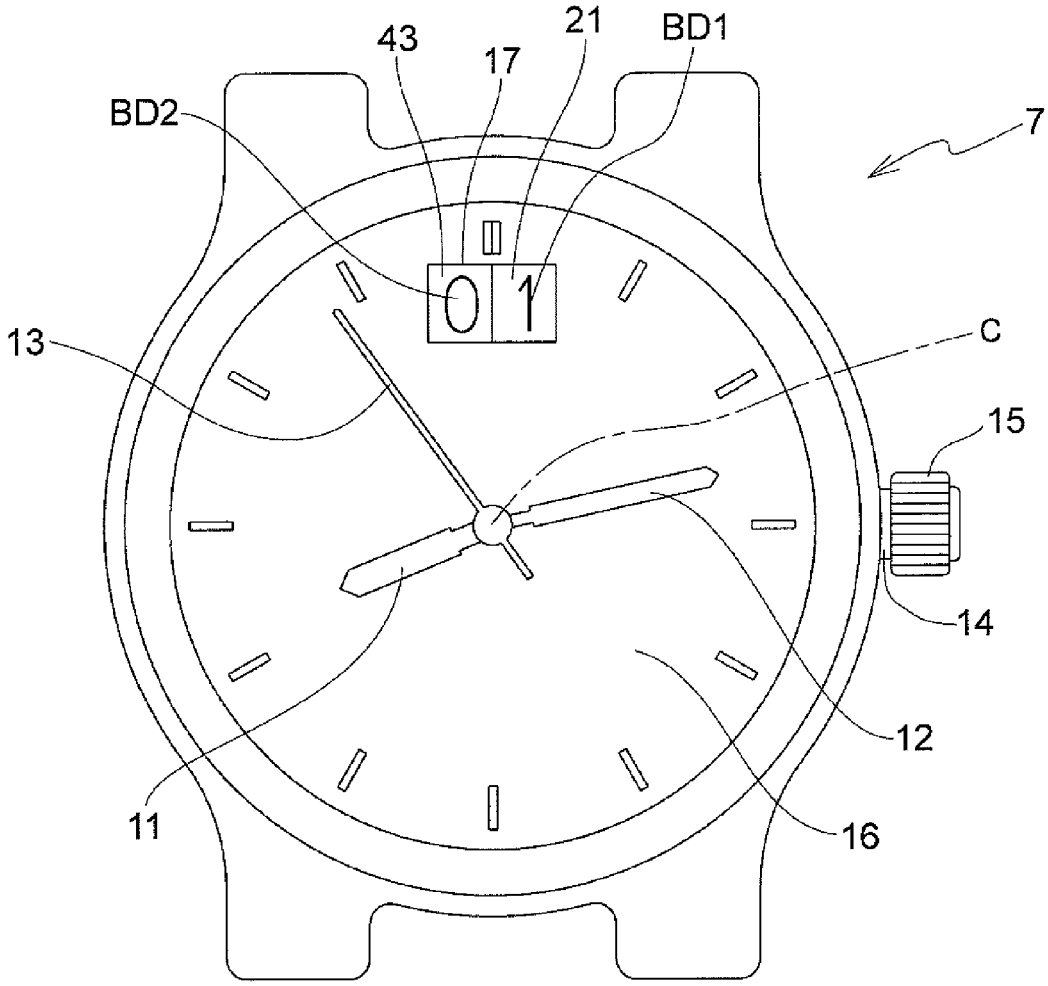
FIG. 3 is a plane diagram showing the exterior appearance of the timepiece shown in FIG. 1.

For example, as shown in FIG. 3, when the date window 17 of the dial 16 displays the "01st" date, the first date indicator 20 is approximately in a rotation position in the C1 direction as shown in FIG. 1, the right half area in the date window 17 (indicated by the imaginary line in FIG. 1) displays "1" on the ones position (first digit) of a date.

In this state, the forward end portion 63 of the arm portion 61 forming the cam follower of the second date indicator operating lever 60 comes into contact with the first cam arc-like portion 31 in practice in the vicinity of the transition surface portion 38 of the drive cam portion 30. The second date indicator operating tooth portion 64 at the forward end of the arm portion 62 of the second date indicator operating lever 60 meshes with the second date indicator tooth portion 41 of the second date indicator 40 by the tooth 64*a*. Therefore, in the second date display surface portion 43 of the second date plate portion 42 of the second date indicator 40, "0" among the date characters BD2 of the tens position in FIG. 2 is positioned in the left half area of the date window 17. As a result, the right side window 44 displaying "0" is positioned in the date window 17, the left side frame of the window 44 extends to the center of the date window 17, and "1" as the date character BD1 of the first date indicator 20 is positioned in the window 44 of the date window 17.

In the retrograde big date display mechanism 1 of the timepiece 7, the date finger 72 of the date indicator driving wheel 70 is engaged with the teeth 23 of the first date indicator tooth portion 24 of the first date indicator 20. In most periods of time other than the relatively short period of time of rotating the tooth portion 24, the jump-and stop claw portion 28 of the first date jumper 26 is fitted between the teeth 23 and 23 adjacent to the first date indicator tooth portion 24 of the first date indicator 20 to set the first date indicator 20 completely. Therefore, since the first date indicator 20 is maintained in the stop state in a predetermined rotation position in the C1 direction, the date character BD1 of the ones position (first digit) in the first date display surface portion 21 of the first date indicator 20 can be accurately positioned in a predetermined position of the right half area of the date window 17. As a result, an appropriate display of the date character BD1 can be performed.

Particularly, in the retrograde big date display mechanism 1 of the timepiece 7, in most periods of time in one day other than the relatively short period of time in which the date finger 72 of the date indicator driving wheel 70 is engaged with the teeth 23 of the first date indicator tooth portion 24 of the first date indicator 20 to rotate the tooth portion 24, the jump-and-stop claw portion 28 of the first date jumper 26 is fitted between the teeth 23 and 23 adjacent to the first date indicator tooth portion 24 of the first date indicator 20 and the jump-and-stop claw portion 52 of the second date jumper 50 is also fitted between the claw portions 46 and 46 adjacent to the second date indicator claw wheel portion 45 of the second date indicator tooth portion 41 of the second date indicator 40 to set the second date indicator 40 completely. As a result, the second date indicator 40 in addition to the first date indicator 20 is maintained in the stop state in a predetermined position in the C1 direction. Therefore, the date character BD2 of the tens position (second digit) of the second date display surface portion 43 of the second date indicator 40 can be accurately positioned in a predetermined position of the left half area in the date window 17 to perform an appropriate display of the date character BD2. In addition, the window 44 which is located on the right side of the date character BD2 indicating the tens position 10 (second digit) of the second date display surface portion 43 of the second date indicator 40 can be accurately positioned in a predetermined position of the right half area in the date window 17, that is, in a position including the first date character BD1 at the center, which allows an appropriate display of the date character BD1.

Here, the forced setting, which is set by the second date jumper 50, of the rotation position of the second date indicator tooth portion 41 in the C1 direction is stronger than the forced pressing of the forward end 63 of the arm portion 61, which forms the cam follower of the second date indicator operating lever 60, against the cam arc-like portion 31. For example, even when the position accuracy of the arc-like peripheral surface of the first cam arc-like portion 31 is low or when the position accuracies of the arm portions 61 and 62 of the operating lever 60 or the like are low to some extent, the second date indicator 40 can be accurately positioned without any influence in practice.

More specifically, the respective cam portions of the drive cam portion 30, that is, the cam arc-like portions 31, 32, 33, and 34 are formed slightly low (the distance from the center axis line C is slightly smaller) such that, when the forward end portion 63 of the arm portion 61 forming the cam follower of the second date indicator operating lever 60 comes into contact with the cam arc-like portions 31, 32, 33, and 34, the rotation position in the C1 direction in which the second date indicator tooth portion 41 is positioned (that is, the rotation position in the C1 direction in which the second date indicator claw wheel portion 45, which is integrally provided with the second date indicator tooth portion 41, is positioned) is a temporal rotation position slightly before a rotation position in which the second date indicator claw wheel portion 45 should be positioned. Therefore, when the jump-and-stop claw portion 52 of the second date jumper 50 is pressed against between the adjacent claw portions 46 and 46 of the claw wheel portion 45 of the second date indicator tooth portion 41 under the action of the second date jumper spring 59 so as to set the second date indicator claw wheel portion 45 completely, the second date indicator claw wheel portion 45 rotates slightly but further in the C1 direction. In response thereto, the operating lever 60 slightly rotates in the E2 direction against the operating lever spring 69. Accordingly, the forward end portion 63 of the arm portion 61 forming the cam follower of the operating lever 60 slightly moves away from the corresponding cam surfaces, that is, the cam arc-like portions 31, 32, 33, and 34 to form a small space 65. Therefore, in the retrograde big date display mechanism 1, even when the position accuracies of the arc-like peripheral surfaces of the cam arc-like portions 31, 32, 33, and 34 are low or when the position accuracies of the arm portions 61 and 62 of the operating lever 60 or the like are low to some extent, the second date indicator 40 can be accurately positioned without any influence in practice.

However, for example, in a case where the arm portion 61 is formed so as to rotate clockwise from a reference position relative to the arm portion 62, the arm portion 61 is prevented from passing the reference position relative to the arm portion 62 and relatively rotating counterclockwise, and the relative rotation is performed clockwise against a relatively strong spring, the cam arc-like portions 31, 32, 33, and 34 may be positioned slightly higher than the original position.

When the end of day approaches, the date finger 72 of the date indicator driving wheel 70 is engaged with the teeth 23 adjacent to the first date indicator tooth portion 24 to rotate the first date indicator tooth portion 24 by one tooth in the C1 direction. Accordingly, the first date jumper 26 performs the jump-and-stop operation of the teeth 23 of the first date indicator tooth portion 24 and is fitted between the next adjacent teeth 23 and 23 to set the first date indicator 20 in a position of rotating by one tooth in the C1 direction. When the first date jumper 26 performs the jump operation, the second date jumper 50 is engaged with the engagement protrusion 27*a* of the first date jumper 26 by the engagement protrusion 54 to be temporarily in a setting releasing position and to return to a setting position immediately thereafter. Therefore, the second date indicator 40 is maintained at the same position in practice. When the second date jumper 50 starts again the setting of the second date indicator claw wheel portion 45, the second date indicator 40 is positioned again in the original accurate position.

The above-described operation can continue until the "09th" date. When the "09th" date is shifted to the "10th" date, the second date indicator operating lever 60 rotates in the E2 direction along with the rotation of the first date indicator 20 in the C1 direction and the same operation is performed except that the second date indicator 40 rotates in the C1 direction. Then, until the end of the month, the above-described operation is repeated.

When the end of the month is shifted to the beginning of month, the first date jumper 26 rotates in the D2 direction along with the progress of the date unlocking of the first date indicator 20. Accordingly, the second date jumper 50 is engaged with the engagement protrusion 27*a* of the first date jumper 26 by the engagement protrusion 54 to be in the setting releasing position of allowing the rotation of the second date indicator tooth portion 45 and to be in a state of allowing the free rotation of the second date indicator 40. At this time, the forward end portion 63 of the arm portion 61 of the second date indicator operating lever 60 reaches the transition surface portion 38 of the drive cam portion 30 along with the rotation of the first date indicator 20 in the C1 direction, falls toward the first cam arc-like portion 24 under the action of the operating lever spring 69, and rapidly rotates the second date indicator tooth portion 41 in a C2 direction through the second date indicator operating tooth portion 64 of the operating lever 60. Accordingly, the retrograde operation is performed, in which the second date indicator 40 rapidly rotates in the C2 direction (counterclockwise) opposite to the C1 direction and returns from the rotation position displaying the date character "3" of the tens position (second digit) in the date window 17 (rotation position shown in FIG. 2) to the rotation position displaying the date character "0" of the tens position (second digit) in the date window 17 (rotation position shown in FIG. 3).

That is, in the retrograde big date display mechanism 1 of the timepiece 7, on one hand, the second date jumper 50 performs the jump-and-stop operation of the claw wheel portion 45 integrally provided with the tooth portion 41 of the second date indicator 40, which can display the date character BD2 in an accurate position. On the other hand, when the end of the month is shifted to the beginning of month, the first date jumper 26 releases the setting, which is set by the second date jumper 50, of the second date indicator tooth portion 41 (the second claw wheel portion 45 thereof) of the second date indicator 40 through the engagement or interference between the engagement protrusion 27*a* and 54. Therefore, it is allowable that the second date indicator 40 rapidly rotates in the C2 direction to return to the initial position, which allows a predetermined retrograde operation.

That is, in the retrograde big date display mechanism 1 of the timepiece 7, the first and second date jumpers 26 and 50 can be engaged with the engagement protrusions 27*a* and 54. Therefore, both of the benefit from the retrograde display and the benefit from the setting (positioning) set by the jumpers are realized at the same time.

Hereinbefore, the example in which the setting of the second indicator 40 set by the second date jumper 50 is released by the first date jumper 26 has been described. Instead, for example, as shown in FIG. 4, the setting of the second date indicator 40 set by the second date jumper may be directly released not by the first date jumper but by the first date indicator 20 (the setting releasing means may include the first date indicator 20).

Figure 4:
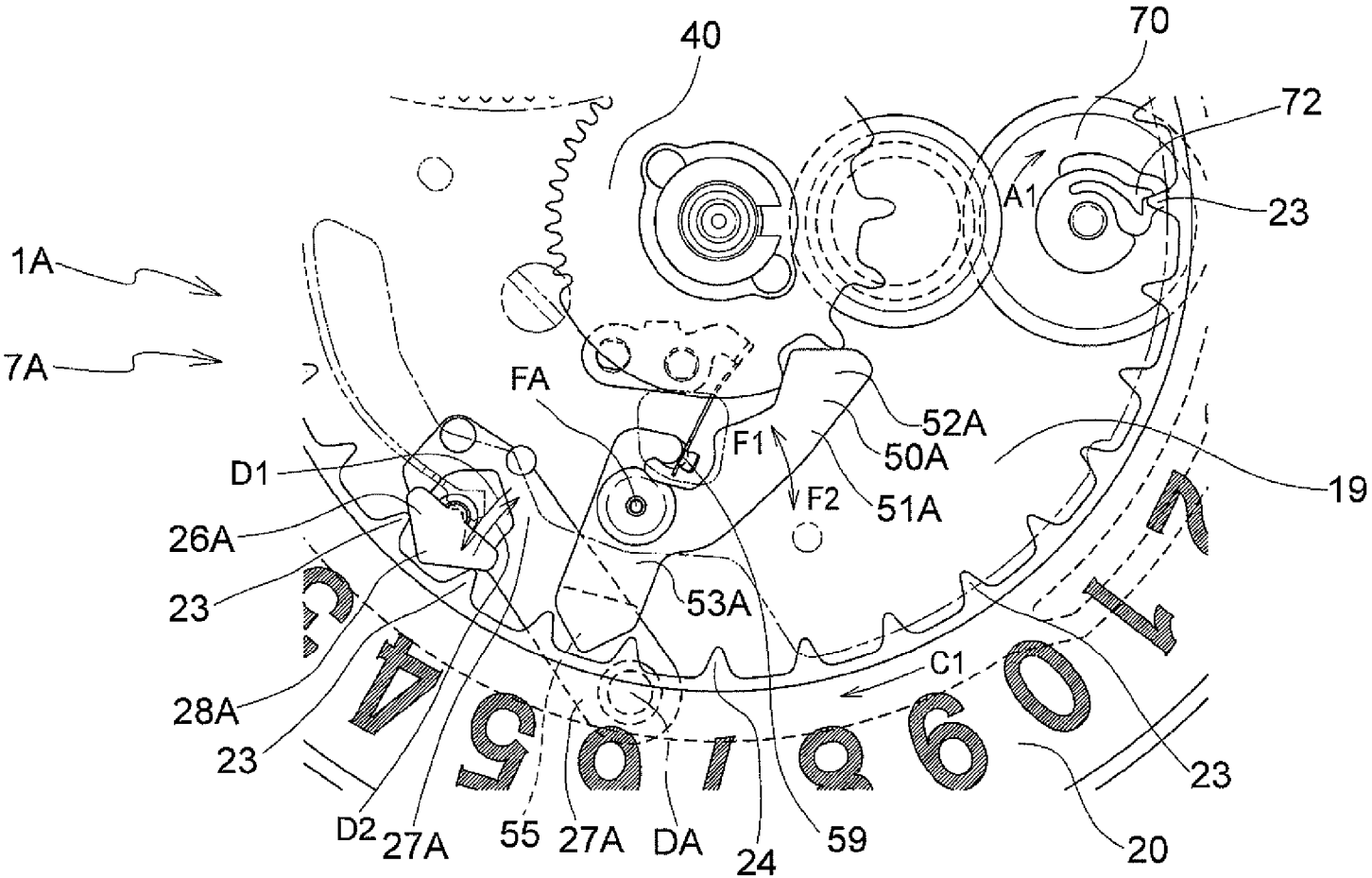
FIG. 4 is a plane diagram showing a modification of the retrograde big date display mechanism as the retrograde display mechanism of the timepiece shown in FIG. 1.

FIG. 4 shows a part of timepiece 7A having a retrograde big date display mechanism 1A as a retrograde display mechanism according to a modification of the present invention. The retrograde big date display mechanism 1A shown in FIG. 4 has the same structure as that of the retrograde big date display mechanism 1 shown in FIG. 1 except that the structures (shapes, arrangement, and joining relationship) of a first date jumper 26A and a second date jumper 50A are different from the structures (shapes, arrangement, and joining relationship) of the first date jumper 26 and the second date jumper 50 of the retrograde big date display mechanism 1 shown in FIG. 1. In the retrograde big date display mechanism 1A shown in FIG. 4, the same reference numerals are given to practically the same components as those of the retrograde big date display mechanism 1 shown in FIG. 1. To components which have different points from but correspond to those of the components of the retrograde big date display mechanism 1 shown in FIG. 1, A is added after the same reference numeral.

The first date jumper 26A which can rotate about a center axis line DA in the D1 and D2 directions includes a jumper main body portion 27A as a form of lever and a jump-and-stop claw portion 28A which performs the jump-and-stop operation of the first date indicator tooth portion 24 and receives the spring load of the first date jumper spring (not shown) in the D1 direction.

In brief, the first date jumper 26A is different from the first date jumper 26 shown in FIG. 1 and has approximately the same structure as that of the first date jumper 26 in FIG. 1 except that an engagement portion corresponding to the engagement protrusion 27*a* is omitted.

The second date jumper 50A which can rotate about a center axis line FA in the F1 and F2 directions includes a jump-and-stop claw portion 52A on one side of the forward end portion of an arm portion 51A forming the second date jumper main body and an engaged claw portion 55 which is engaged with the teeth 23 of the first date indicator tooth portion 24 of the first date indicator 20 at the forward end portion of the other arm portion 53A extending in a direction different from the arm portion 51A. The second date jumper 50A is configured such that the engaged claw portion 55 of the arm portion 53A can be directly engaged with the teeth 23 of the first date indicator tooth portion 24 of the first date indicator 20. Therefore, the arm portion 53A is in a position overlapping the jumper main body 27A of the first date jumper 26A in the thickness direction of the timepiece 7A (when seen in the thickness direction, there is a space therebetween) in the engaged claw portion 55 and vicinity thereof. Here, a rotation center DA of the first date jumper 26A is preferably positioned in the vicinity of the circle adjacent to the first date indicator tooth portion 24. In addition, the first date jumper 26A and the second date jumper 50A may be in positions away from each other when seen in the peripheral direction of the timepiece 7A and, in this case, may not be in positions away from each other in the thickness direction. In this retrograde big date display mechanism 1A, the second date jumper 50A performs the jump-and-stop operation of the second date indicator claw wheel portion 45 which is integrally provided with the second date indicator tooth portion 41 of the second date indicator 40 to set the second date indicator claw wheel portion 45. Therefore, the date character BD2 of the tens position (second digit) of the big date can be also accurately displayed in a predetermined position of the date window 17 regardless of errors in the shape of the drive cam portion (not shown), the shape of the cam follower portion (not shown) of the second date indicator operating lever (not shown), and the like.

In the retrograde big date display mechanism 1A having the first date jumper 26A and the second date jumper 50A, when the end of day approaches, the date finger 72 of the date indicator driving wheel 70 is engaged with the adjacent teeth 23 of the first date indicator tooth portion 24 to rotate the first date indicator tooth portion 24 by one tooth in the C1 direction. At this time, in response to the rotation of the first date indicator tooth portion 24 of the first date indicator 20 in the C1 direction, on one hand, the first date jumper 26A performs the jump operation of the teeth 23 of the first date indicator tooth portion 24. On the other hand, the second date jumper 50A receives the rotational force in the C1 direction due to the adjacent teeth 23 of the first date indicator tooth portion 24 (of the first date indicator 20 as the setting releasing means) in the engaged claw portion 55 to rotate in the F2 direction. Accordingly, the jump-and-stop claw portion 52A of the second date jumper 50A releases the setting (of the claw wheel portion 45) of the second date indicator tooth portion 41 of the second date indicator 40. In this case, when the first date jumper 26A completes the resetting of the first date indicator 20 after the jump operation, the jump-and-stop claw portion 52A of the second date jumper 50A also returns to the setting position of the second date indicator claw wheel portion 45. The engaged claw portion 55 of the second date jumper 50A is in a position practically not interfering with the teeth 23 of the first date indicator tooth portion 24 (typically, before the completion of the setting of the first date indicator tooth portion 24 set by the first date jumper 26A, the resetting of the second date indicator 40 set by the second date jumper 50A is completed).

Thereafter, similar to a case of the retrograde big date display mechanism 1 shown in FIG. 1, the above-described operation is repeated. Even in the retrograde big date display mechanism 1A shown in FIG. 4, similar to the retrograde big date display mechanism 1 shown in FIG. 1, the date characters BD1 and BD2 of the big date can be accurately positioned in predetermined positions of the date window 17.

Hereinbefore, the example of the retrograde big date display mechanism has been described, in which, when the end of the month is shifted to the beginning of month, the date character BD2 of the tens position (second digit) returns to "0" using the retrograde display mechanism. Instead, for example, the features of the retrograde display mechanism according to the present invention can be realized even in a retrograde day display mechanism in which the display of day when the end of the week is shifted to the beginning of week returns from "Saturday" to "Sunday", for example.

Figure 6:
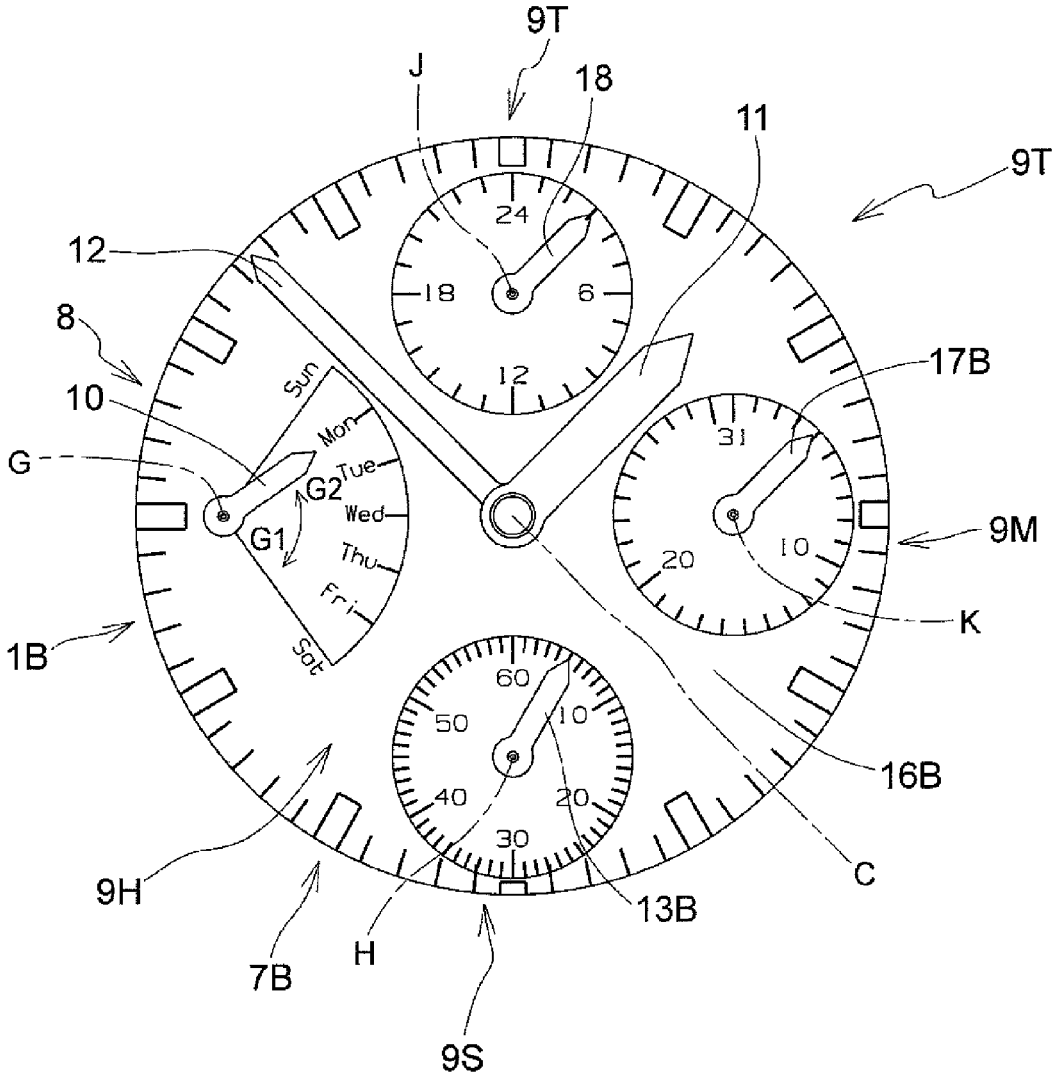
FIG. 6 is a plane diagram showing a part of timepiece having the retrograde day display mechanism shown in FIG. 5 as a retrograde display mechanism.

FIG. 6 shows an example of a timepiece 7B having a retrograde day display mechanism 1B as a retrograde display mechanism which includes a retrograde day display portion 8 performing the retrograde display for the day.

As shown in FIG. 6, the timepiece 7B includes the retrograde day display portion 8 using a day hand or day display hand 10 in addition to an hour and minute display portion 9H using the hour hand 11 and the minute hand 12 similar to the timepiece 7 shown in FIG. 3. The timepiece 7B further includes a small second display portion 9S using a small second hand 13B, 24 hour display portion 9T using a 24 hour hand 18, and a date display portion 9M using a date hand 17B. However, the display portions 9M and 9T may not be provided. As seen from FIG. 6, the day display hand 10 can rotate about a center axis line G located in the nine o' clock position in G1 and G2 directions, the small second hand 13B can rotate about a center axis line H located in the six o' clock position, the 24 hour hand 18 can rotate about a center axis line J located in the twelve o'clock position, and the date hand 17B can rotate about a center axis line K located in the three o'clock position. In addition, the day display hand 10 intermittently rotates by one step in the G1 direction whenever the day changes until Saturday from Sunday and, when the end of the week is shifted to the beginning of week, rapidly returns in the G2 direction from the Saturday position located in the end in the G1 direction to the Sunday position located in the end in the G2 direction, that is, performs the retrograde operation.

Figure 5:
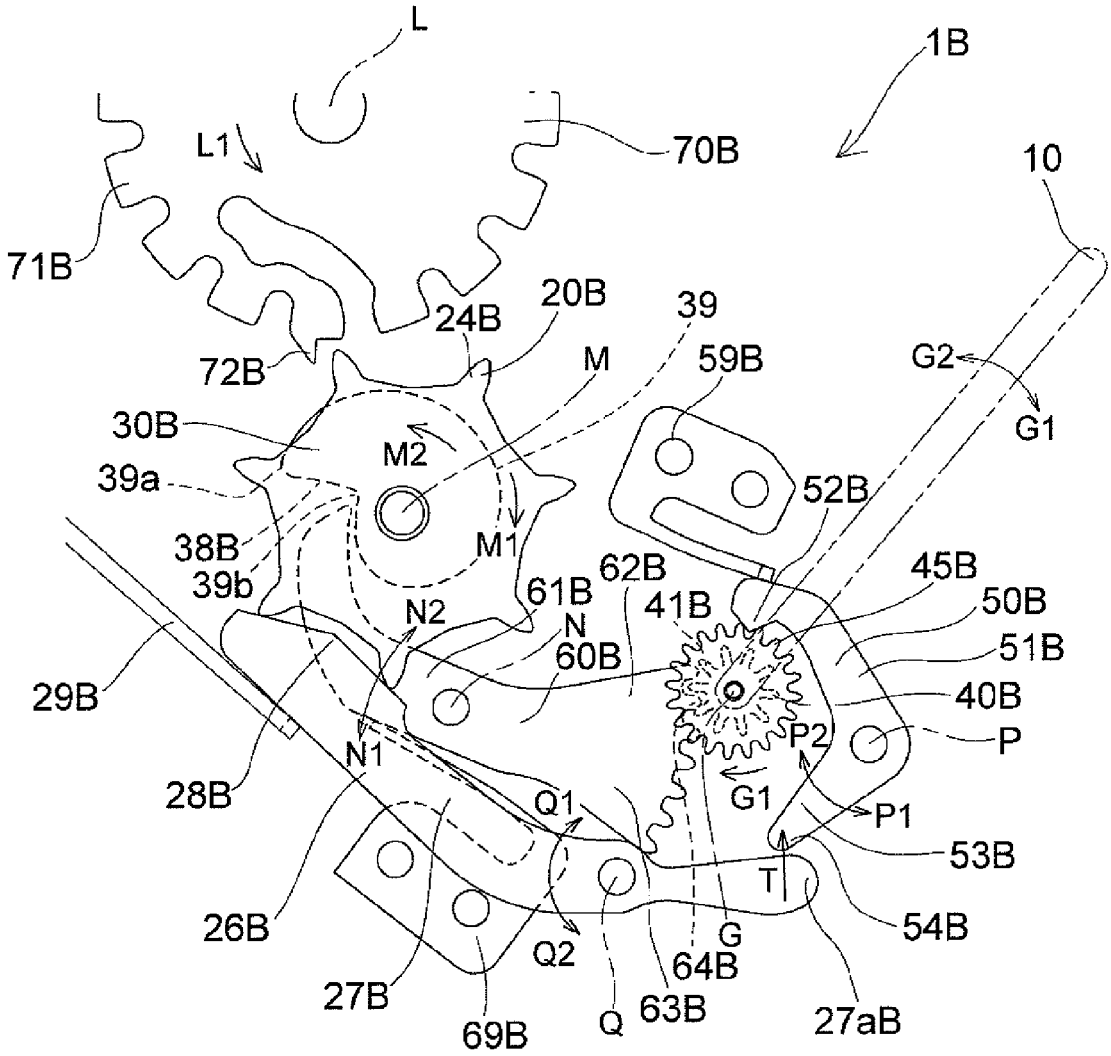
FIG. 5 is a plane diagram showing a structure of a retrograde day display mechanism as another modification of the retrograde display mechanism of the timepiece shown in FIG. 1.

As seen from FIG. 5, the retrograde day display mechanism 1B as the retrograde display mechanism includes a day indicator driving wheel 70B as a time value driving wheel, a day transmitting wheel 20B as a time value transmitting wheel, a hammer 60B as a fan-shaped wheel operating lever, a small day indicator 40B as a fan-shaped wheel, a small day jumper 50B as a fan-shaped wheel jumper, and a day jumper 26B.

In the retrograde day display mechanism 1B shown in FIG. 5, components having the same functions as those of the retrograde big date display mechanism 1 shown in FIG. 1 add B after the same reference numeral.

The day indicator driving wheel 70B which rotates about a center axis line L in a L1 direction due to a wheel of a needle-handling train wheel such as an hour wheel (hour indicator) includes a day indicator driving wheel tooth portion 71B as a time value driving wheel tooth portion and a day finger 72B as a time value finger.

The day transmitting wheel 20B includes a day transmitting wheel tooth portion 24B as a time value transmitting wheel tooth portion which rotates about a central axis line M by one tooth every day due to the day finger 72B of the day indicator driving wheel 70B in a M1 direction and a day transmitting wheel cam portion 30B as a drive cam portion. The day transmitting wheel cam portion 30B include a main cam surface portion 39 in which the distance from a center M (radial position) gradually increases in a M2 direction (direction opposite to the M1 direction) as in Archimedes' spiral and a transition portion or transition surface portion 38B connecting a maximum diameter portion 39*a* and a minimum diameter portion 39*b* of the main cam surface portion 39.

The hammer 60B can rotate about a center axis line N in N1 and N2 direction and includes arm portions 61B and 62B on both sides of the center axis line N. The arm portion 61B of the hammer 60B is elastically pressed against the cam portion 30B of the day transmitting wheel 20B by a hammer return spring 69B and acts as a cam follower portion which is engaged with the day transmitting wheel cam portion 30B. The arm portion 62B of the hammer 60B includes a small day indicator operating tooth portion 64B as a fan-shaped wheel operating tooth portion at a forward end 63B.

The small day indicator 40B as a fan-shaped wheel meshes the small day indicator operating tooth portion 64B of the hammer 60B and includes a small day indicator tooth portion 41B which rotates about the center axis line G in the G1 and G2 directions in response to the rotation of the hammer 60B in the N1 and N2 direction and a small day indicator claw wheel portion 45B. In the example, the small day indicator tooth portion 41B and the small day indicator claw wheel portion 45B which extend in an arc-like shape are located on the different circle in the different plane. A small day hand 10 as a fan-shaped wheel display portion is attached to the small day indicator 40B so as to rotate about the center axis line G in the G1 and G2 directions.

The small day jumper 50B which can rotate about a center axis line P in P1 and P2 directions includes a jump-and-stop claw portion 52B on one side of the forward end portion of one arm portion 51B forming the jumper main body portion and performs the jump-and-stop operation of the small day indicator claw wheel portion 45B of the small indicator 40B using the jump-and stop claw portion 52B under the action of a small day jumper spring 59B. The forward end portion of the other arm portion 53B of the small day jumper 50B is an engaged portion 54B.

The day jumper 26B which can rotate about a center axis line Q in Q1 and Q2 directions includes a jump-and-stop claw portion 28B on one side of the forward end portion of one arm portion 27B forming the jumper main body portion and performs the jump-and-stop operation of the tooth portion 24B of the day transmitting wheel 20B using the jump-and stop claw portion 28B under the action of a day jumper pressing spring portion 29B extending from a setting wheel plate (not shown), for example. In the forward end portion of the other arm portion of the day jumper 26B which also acts as the setting releasing means, an engagement protrusion 27*a*B as a form of lever is formed.

When the day jumper 26B as the setting releasing means rotates in the Q2 direction due to the tooth portion 24B of the day transmitting wheel 20B during the jump-and-stop operation (performs the jump operation), the engagement protrusion 27*a*B of the day jumper 26B presses in a T direction the engaged portion 54B of the small day jumper 50B opposite thereto in the Q2 direction. Therefore, the small day jumper 50B rotates about the center axis line P in the P2 direction to release the setting of the small day indicator claw wheel portion 45B.

As a result, when the day is changed every day, the day jumper 26B releases the setting, which is set by the small day jumper 50B, of the claw wheel portion 45B of the small day indicator 40B through the engagement between the engagement portion 27*a*5 and the engaged portion 54B of the small day jumper 50B. Therefore, even when the end of the week passes (when the day is changed on a seven days basis), the day jumper 26B releases the setting of the small day jumper 50B for the small day indicator 40B through the engagement between the engagement portion 27*a*B and the engaged portion 54B of the small day jumper 50B.

In the retrograde display mechanism 1B, when the forward end portion of the arm portion 61B forming the cam follower of the hammer 60B is positioned in the minimum diameter portion 39*b* or the vicinity thereof of the transition portion 38B of the day transmitting wheel cam portion 30B, the hammer 60B is in a position of rotating in the N2 direction to the maximum, the small day indicator 40B rotates in the G2 direction to the maximum, and the small day hand 10 which is attached to the small day hand 40B is in a position of displaying Sunday at the end in G2 direction.

Whenever the day indicator driving wheel 70B rotates once in the L1 direction along with the progress of time, the day transmitting wheel 20*b* rotates in the M1 direction by one tooth of the day transmitting wheel tooth portion 24B. Accordingly, the hammer 60B which is in contact with the main cam surface portion 39 of the day transmitting wheel cam portion 30B intermittently rotates in the N1 direction due to the arm portion 61B forming the cam follower and the small day indicator 40B and the small day hand 10 intermittently rotates in the G1 direction by the amount corresponding to one day.

Here, the rotation position of the small day hand 10 in the G1 direction is preliminarily set by the day transmitting wheel cam portion 30B and the hammer 60B. However, the final rotation position of the small day hand 10 in the G1 direction is determined by the claw wheel portion 453 of the small day indicator 40B and the small day jumper 50B setting the claw wheel portion 45B. That is, typically, the main cam surface portion 39 of the cam surface 30B is formed in advance such that the preliminary rotation positions, which are determined by the cam portion 30B and the hammer 60B, of the small day indicator 40B and the small day hand 10 in the G1 direction are slightly deviated in the G2 direction (are positioned in the front when seen in the G1 direction) from the rotation position in the G1 direction which should be finally positioned. In this case, when the jump-and-stop claw portion 52B of the small day jumper 50B performs the setting operation for the small day indicator claw wheel portion 45B of the small day indicator 40B located in the preliminary rotation position under the action of the small day jumper spring 59B so as to be fitted into the adjacent claw portions of the small day indicator claw wheel portion 45B, the small day indicator 40B having the small day indicator claw wheel portion 45B further rotates in the G1 direction. That is, the small day jumper spring 59B of the small day jumper 50B overcomes the torque caused by the spring force of the hammer spring 69B to rotate the hammer 60B in the N1 direction through the small day indicator 40B. That is, the arm portion of the hammer 60B, that is, the forward end portion of the cam follower portion 61B is slightly separated from the main cam surface 39 of the cam portion 30.

In addition, in a case where the day transmitting wheel 20B can rotate in the M2 direction by applying a force to the cam portion 30B through the hammer 60B, the rotation position in the G1 direction may be set by the cam portion 30B as accurately as possible.

The intermittent rotation operation of the small day indicator 40B and the small day hand 10 in the G1 direction along with the above-described rotation of the day indicator driving wheel 70B is repeated until the Saturday night. In addition, as described above, when the day is changed every day, the day jumper 26B releases the setting, which is set by the small day jumper 50B, of the claw wheel portion 45B of the small day indicator 40B through the engagement between the engagement portion 27*a*3 and the engaged portion 54B of the small day jumper 50B.

When Saturday is shifted to Sunday at the end of the week, the small day jumper 50B releases the rotation setting of the small day indicator claw wheel portion 45B such that the small day indicator 40B freely rotates, the small day jumper 50B rotating in the P2 direction by receiving a force T through the engaged portion 54B due to the engagement protrusion 27*a*B of the day jumper 26B which rotates in the Q2 direction along with the rotation of the day transmitting wheel 20B in the M1 direction to perform the jump operation. Therefore, when Saturday is shifted to Sunday on the end of the week, the forward end portion of the arm portion 61B forming the cam follower of the hammer 60B reaches the maximum diameter portion 39*a* of the cam portion 30B of the day transmitting wheel 20B along with the rotation of the day transmitting wheel 20B in the M1 direction. When the forward end portion passes the maximum diameter portion 39*a*, the hammer 60B falls into the minimum diameter portion 39*b* under the action of the hammer return spring 69B. That is, the hammer 60B rotates about the center axis line N in the N2 direction under the action of the hammer return spring 69B, the small day indicator 40B rotates in the G2 direction through the meshing between the tooth portions 64B and 41B, and the small day hand 10 returns from the end in the G1 direction indicating Saturday to the end in the G2 direction indicating Sunday, that is, performs the retrograde operation.

Hereinabove, an example in which the setting of the small day indicator 40B set by the small day jumper 50B is released by the day jumper 26B has been described. Instead, as shown in FIG. 7, the setting of the small day indicator 40B set by the small day jumper may be directly released not by the day jumper but by the day transmitting wheel 20B.

Figure 7:
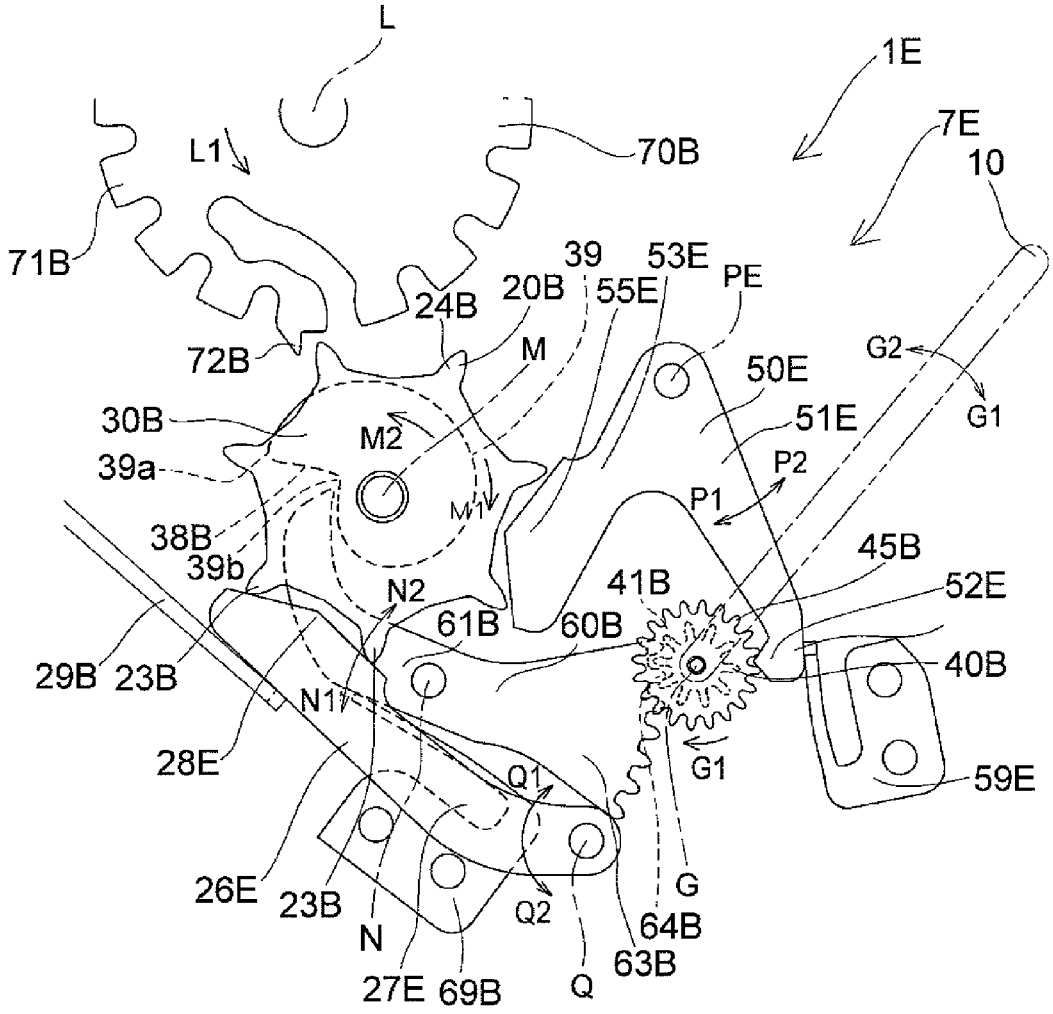
FIG. 7 is a plane diagram showing a modification of the retrograde day display mechanism as the retrograde display mechanism shown in FIG. 5.

FIG. 7 shows a part of timepiece 7E having a retrograde day display mechanism 1E as a retrograde display mechanism according to another modification of the present invention. The retrograde day display mechanism 1E shown in FIG. 7 has approximately the same structure as that of the retrograde day display mechanism 1B shown in FIG. 5 except that the structures (shapes, arrangement, and joining relationship) of a day jumper 26E and a small day jumper 50E are different from the structures (shapes, arrangement, and joining relationship) of the day jumper 26B and the small day jumper 50B of the retrograde day display mechanism n shown in FIG. 5. To be exact, a shape or the like of the small day jumper spring 59E is also changed according to the change in shape or the like of the small day jumper 50E. Further, more specifically, the relative positions in the peripheral direction of the (fan-shaped) tooth portion 41B and the (fan-shaped) claw wheel portion 45B of the small day indicator 40B is also changed as desired according to the change in shape and arrangement of the small day jumper 50E. However, here, in order to simplify the description, the same reference numeral is given assuming that they are the same in practice. In the retrograde day display mechanism 1E shown in FIG. 7, the same reference numerals are given to practically the same components as those of the retrograde day display mechanism 1B shown in FIG. 5. To components which have different points from but correspond to the components of the retrograde day display mechanism 1B shown in FIG. 4, E is added at the end instead of B. To components which have different points from but correspond to the components of the retrograde big date display mechanism 1A as the retrograde display mechanism shown in FIG. 3, E is added at the end instead of A.

In brief, the day jumper 26E is different from the day jumper 26B shown in FIG. 5 and has approximately the same structure as that of the day jumper 26B show in FIG. 5 except that an engagement portion corresponding to the engagement protrusion 27*a*B is omitted. The day jumper 26E includes a jumper main body 27E as a form of lever and a jump-and-stop claw portion 28E which performs the jump-and-stop operation of the day transmitting wheel tooth portion 24B, can rotate about the center axis line Q in the Q1 and Q2 directions, and receives a force in the Q1 direction through the day jumper pressing spring portion 29B.

The small day jumper 50E which can rotate about a center axis line PE in the P1 and P2 directions includes a jump-and-stop claw portion 52E on one side of the forward end portion of an arm portion 51E forming the small day jumper main body and an engaged claw portion 55E which is engaged with teeth 23B of the day transmitting wheel tooth portion 24B of the day transmitting wheel 20B at the forward end portion of the other arm portion 53E extending in a direction different from the arm portion 51E. In this retrograde big date display mechanism 1E, the small day jumper 50E performs the jump-and-stop operation of the small day indicator claw wheel portion 45B which is integrally provided with the small day indicator tooth portion 41B of the small day indicator 40B to set the small day indicator claw wheel portion 45B. Therefore, the small day hand 10 can be accurately positioned in a predetermined position of the fan-shaped display portion 8 (also see FIG. 6) to perform an appropriate day display, regardless of errors in the shape of the day transmitting wheel cam portion 30B of the day transmitting wheel 20B, the shape of the arm portion 61B forming the cam follower of the hammer 60B, and the like.

In the retrograde day display mechanism 1E having the day jumper 26E and the small day jumper 50E, when the end of each day (one day) approaches, the day finger 72B of the day indicator driving wheel 70B is engaged with the adjacent teeth 23B of the day transmitting wheel tooth portion 24B to rotate the day transmitting wheel tooth portion 24B by one tooth in the M1 direction. At this time, in response to the rotation of the day transmitting wheel tooth portion 24B of the day transmitting wheel 20B in the M1 direction, on one hand, the day jumper 26E performs the jump operation of the teeth 23B of the day transmitting wheel tooth portion 24B. On the other hand, the small day jumper 50E receives the rotational force in the M1 direction due to the adjacent teeth 23B of the day transmitting wheel tooth portion 24B in the engaged claw portion 55E to rotate in the P2 direction. Accordingly, the jump-and-stop claw portion 52E of the small day jumper 50E releases the setting (of the claw wheel portion 45B) of the small day indicator tooth portion 41B of the small day indicator 40B. In this case, when the day jumper 26E completes the resetting of the day transmitting wheel 20B after the jump operation, the jump-and-stop claw portion 52E of the small day jumper 50E also returns to the setting position of the small day indicator claw wheel portion 45B. The engaged claw portion 55E of the small day jumper 50E is in a position practically not interfering with the teeth 23B of the day transmitting wheel tooth portion 24B (typically, before the completion of the setting of the day transmitting wheel tooth portion 24B set by the day jumper 26E, the resetting of the small day indicator 40B set by the small day jumper 50E is completed).

Thereafter, similar to a case of the retrograde day display mechanism 1B shown in FIG. 5, the above-described operation is repeated. Even in the retrograde day display mechanism 1E shown in FIG. 7, similar to the retrograde day display mechanism 1B shown in FIG. 5, the small day hand 10 can be accurately positioned in a predetermined position of the fan-shaped display portion 8 of a dial 16B to perform an appropriate day display.

When Saturday is shifted to Sunday on the end of the week, the small day jumper 50E receives the rotation force in the P2 direction from the tooth portion 23B of the day transmitting wheel tooth portion 24B of the day transmitting wheel 20B as the setting releasing means in the engaged portion 54E along the rotation of the day transmitting wheel 20B in the M1 direction. The jump-and-stop claw portion 52E of the small day jumper 50E rotates in the P2 direction to release the rotation setting of the small day indicator claw wheel portion 45B such that the small day indicator 40B freely rotates. Therefore, when Saturday is shifted to Sunday on the end of the week, the forward end portion of the arm portion 61B forming the cam follower of the hammer 60B reaches the maximum diameter portion 39*a* of the cam portion 30B of the day transmitting wheel 20B along with the rotation of the day transmitting wheel 20B in the M1 direction. When the forward end portion passes the maximum diameter portion 39*a*, the hammer 60B falls into the minimum diameter portion 39*b* under the action of the hammer return spring 69B. That is, the hammer 60B rotates about the center axis line N in the N2 direction under the action of the hammer return spring 69B, the small day indicator 40B rotates in the G2 direction through the meshing between the tooth portions 64B and 41B, and the small day hand 10 returns from the end in the G1 direction indicating Saturday to the end in the G2 direction indicating Sunday, that is, performs the retrograde operation.

What is claimed is:

1. A retrograde display mechanism comprising:

a retrograde display mechanism main body including a time value driving wheel that has a time value driving tooth portion and time value finger which advance a time value including a date or a day and that rotates once every day, a time value transmitting wheel that has a time value transmitting wheel tooth portion and a drive cam portion which are rotated by one tooth every day by the time value finger of the time value driving wheel, a fan-shaped wheel operating lever that has a cam follower portion and a fan-shaped wheel operating tooth portion which are elastically pressed against the drive cam portion of the time value transmitting wheel to be engaged with the drive cam portion, and a fan-shaped wheel that has a fan-shaped wheel tooth portion and a fan-shaped wheel display portion which mesh with the fan-shaped wheel operating tooth portion of the fan-shaped wheel operating lever to rotate in response to the rocking of the fan-shaped wheel operating lever, in which the fan-shaped wheel rapidly rotates reversely to return to an initial position whenever the end of the month or the end of the week passes;

a fan-shaped wheel jumper that jumps and stops the fan-shaped wheel tooth portion of the fan-shaped wheel; and setting releasing means that releases a setting set by the fan-shaped wheel jumper whenever the end of the month or the end of the week passes.

2. The retrograde display mechanism according to claim 1, wherein the time value includes a date, the time value driving wheel includes a date indicator driving wheel, the time value transmitting wheel includes a first date indicator which has a first date plate portion displaying the ones position of a date, the fan-shaped wheel operating lever includes a second date indicator operating lever, the fan-shaped wheel includes a second date indicator displaying the tens position of a date, the fan-shaped wheel tooth portion includes a second date display wheel, and the fan-shaped wheel jumper includes a second date jumper, the retrograde display mechanism comprising:

a retrograde display mechanism main body including the date indicator driving wheel that has a date indicator driving wheel tooth portion and a date finger and rotates once every day, the first date indicator that has a first date indicator tooth portion and a drive cam portion which are rotated by one tooth every day by the date finger of the date indicator driving wheel, the second date indicator operating lever that has a cam follower portion and a second date indicator operating tooth portion which are elastically pressed against the drive cam portion of the first date indicator to be engaged with the drive cam portion, and the second date indicator that has a second date display wheel and a second date plate portion which mesh with the second date indicator operating tooth portion of the second date indicator operating lever to rotate in response to the rocking of the operating lever, in which the second date indicator rapidly rotates reversely to return to an initial position whenever the end of the month passes;

the second date jumper that jumps and stops the second date display wheel of the second date indicator; and setting releasing means that releases a setting set by the second date jumper whenever the end of the month passes.

3. The retrograde display mechanism according to claim 2, wherein the setting releasing means releases the setting set by the second date jumper whenever the first date indicator rotates by an amount corresponding to one day.

4. The retrograde display mechanism according to claim 3 comprising a first date jumper that jumps and stops the first date indicator tooth portion, wherein the first date jumper displaces the second date jumper so as to release the setting of the second date display wheel set by the second date jumper when the first date indicator rotates by the amount corresponding to one day to pass a tooth of the first date indicator tooth portion.

5. The retrograde display mechanism according to claim 4, wherein the time value includes a day, the time value driving wheel includes a day indicator driving wheel, the time value transmitting wheel includes a day indicator transmitting wheel, the fan-shaped wheel operating lever includes a hammer, the fan-shaped wheel includes a small day indicator, the fan-shaped wheel tooth portion includes a small day indicator tooth portion, and the fan-shaped wheel jumper includes a small day jumper, the retrograde display mechanism comprising:

a retrograde display mechanism main body including the day indicator driving wheel that has a day indicator driving wheel tooth portion and a day finger and rotates once every day, a day transmitting wheel that has a day transmitting wheel tooth portion and a drive cam portion which are rotated by one tooth every day by the day finger of the day indicator driving wheel, the hammer that has a cam follower portion and a small day indicator operating tooth portion which are elastically pressed against the drive cam portion of the day transmitting wheel to be engaged with the drive cam portion, and the small day indicator that has a small day indicator tooth portion and a small day hand which mesh with the small day indicator operating tooth portion of the hammer to rotate in response to the rocking of the hammer, in which the small day indicator rapidly rotates reversely to return to an initial position whenever the end of the week passes;

a small day jumper that jumps and stops the small day indicator tooth portion of the small day indicator; and setting releasing means that releases a setting set by the second day jumper whenever the end of the week passes.

6. The retrograde display mechanism according to claim 5, wherein the setting releasing means releases the setting set by the small day jumper whenever the day transmitting wheel rotates by the amount corresponding one day.

7. The retrograde display mechanism according to claim 3, wherein the second date jumper includes a first date indicator engagement portion engaged with the first date indicator tooth portion, and the second date jumper, when the first date indicator rotates by the amount corresponding to one day, is displaced by the first date indicator engagement portion to release the setting of the second date display wheel.

8. The retrograde display mechanism according to claim 7, wherein the time value includes a day, the time value driving wheel includes a day indicator driving wheel, the time value transmitting wheel includes a day indicator transmitting wheel, the fan-shaped wheel operating lever includes a hammer, the fan-shaped wheel includes a small day indicator, the fan-shaped wheel tooth portion includes a small day indicator tooth portion, and the fan-shaped wheel jumper includes a small day jumper, the retrograde display mechanism comprising:

a retrograde display mechanism main body including the day indicator driving wheel that has a day indicator driving wheel tooth portion and a day finger and rotates once every day, a day transmitting wheel that has a day transmitting wheel tooth portion and a drive cam portion which are rotated by one tooth every day by the day finger of the day indicator driving wheel, the hammer that has a cam follower portion and a small day indicator operating tooth portion which are elastically pressed against the drive cam portion of the day transmitting wheel to be engaged with the drive cam portion, and the small day indicator that has a small day indicator tooth portion and a small day hand which mesh with the small day indicator operating tooth portion of the hammer to rotate in response to the rocking of the hammer, in which the small day indicator rapidly rotates reversely to return to an initial position whenever the end of the week passes;

a small day jumper that jumps and stops the small day indicator tooth portion of the small day indicator; and setting releasing means that releases a setting set by the second day jumper whenever the end of the week passes.

9. The retrograde display mechanism according to claim 8, wherein the setting releasing means releases the setting set by the small day jumper whenever the day transmitting wheel rotates by the amount corresponding one day.

10. The retrograde display mechanism according to claim 3, wherein the time value includes a day, the time value driving wheel includes a day indicator driving wheel, the time value transmitting wheel includes a day indicator transmitting wheel, the fan-shaped wheel operating lever includes a hammer, the fan-shaped wheel includes a small day indicator, the fan-shaped wheel tooth portion includes a small day indicator tooth portion, and the fan-shaped wheel jumper includes a small day jumper, the retrograde display mechanism comprising:

a retrograde display mechanism main body including the day indicator driving wheel that has a day indicator driving wheel tooth portion and a day finger and rotates once every day, a day transmitting wheel that has a day transmitting wheel tooth portion and a drive cam portion which are rotated by one tooth every day by the day finger of the day indicator driving wheel, the hammer that has a cam follower portion and a small day indicator operating tooth portion which are elastically pressed against the drive cam portion of the day transmitting wheel to be engaged with the drive cam portion, and the small day indicator that has a small day indicator tooth portion and a small day hand which mesh with the small day indicator operating tooth portion of the hammer to rotate in response to the rocking of the hammer, in which the small day indicator rapidly rotates reversely to return to an initial position whenever the end of the week passes;

a small day jumper that jumps and stops the small day indicator tooth portion of the small day indicator; and setting releasing means that releases a setting set by the second day jumper whenever the end of the week passes.

11. The retrograde display mechanism according to claim 10, wherein the setting releasing means releases the setting set by the small day jumper whenever the day transmitting wheel rotates by the amount corresponding one day.

12. The retrograde display mechanism according to claim 2, wherein the time value includes a day, the time value driving wheel includes a day indicator driving wheel, the time value transmitting wheel includes a day indicator transmitting wheel, the fan-shaped wheel operating lever includes a hammer, the fan-shaped wheel includes a small day indicator, the fan-shaped wheel tooth portion includes a small day indicator tooth portion, and the fan-shaped wheel jumper includes a small day jumper, the retrograde display mechanism comprising:

a retrograde display mechanism main body including the day indicator driving wheel that has a day indicator driving wheel tooth portion and a day finger and rotates once every day, a day transmitting wheel that has a day transmitting wheel tooth portion and a drive cam portion which are rotated by one tooth every day by the day finger of the day indicator driving wheel, the hammer that has a cam follower portion and a small day indicator operating tooth portion which are elastically pressed against the drive cam portion of the day transmitting wheel to be engaged with the drive cam portion, and the small day indicator that has a small day indicator tooth portion and a small day hand which mesh with the small day indicator operating tooth portion of the hammer to rotate in response to the rocking of the hammer, in which the small day indicator rapidly rotates reversely to return to an initial position whenever the end of the week passes;

a small day jumper that jumps and stops the small day indicator tooth portion of the small day indicator; and setting releasing means that releases a setting set by the second day jumper whenever the end of the week passes.

13. The retrograde display mechanism according to claim 12, wherein the setting releasing means releases the setting set by the small day jumper whenever the day transmitting wheel rotates by the amount corresponding one day.

14. The retrograde display mechanism according to claim 13 comprising a day jumper that jumps and stops the day transmitting wheel tooth portion, wherein the day jumper displaces the small day jumper so as to release the setting of the small day indicator tooth portion set by the small day jumper when the day transmitting wheel rotates by the amount corresponding to one day to pass a tooth of the day transmitting wheel tooth portion.

15. The retrograde display mechanism according to claim 13, wherein the small day jumper includes a day transmitting wheel engagement portion engaged with the day transmitting wheel tooth portion, and the small day jumper, when the day transmitting wheel tooth portion rotates by the amount corresponding to one day, is displaced by the day transmitting wheel engagement portion to release the setting of the small day indicator tooth portion.

16. The retrograde display mechanism according to claim 1, wherein the time value includes a day, the time value driving wheel includes a day indicator driving wheel, the time value transmitting wheel includes a day indicator transmitting wheel, the fan-shaped wheel operating lever includes a hammer, the fan-shaped wheel includes a small day indicator, the fan-shaped wheel tooth portion includes a small day indicator tooth portion, and the fan-shaped wheel jumper includes a small day jumper, the retrograde display mechanism comprising:

a retrograde display mechanism main body including the day indicator driving wheel that has a day indicator driving wheel tooth portion and a day finger and rotates once every day, a day transmitting wheel that has a day transmitting wheel tooth portion and a drive cam portion which are rotated by one tooth every day by the day finger of the day indicator driving wheel, the hammer that has a cam follower portion and a small day indicator operating tooth portion which are elastically pressed against the drive cam portion of the day transmitting wheel to be engaged with the drive cam portion, and the small day indicator that has a small day indicator tooth portion and a small day hand which mesh with the small day indicator operating tooth portion of the hammer to rotate in response to the rocking of the hammer, in which the small day indicator rapidly rotates reversely to return to an initial position whenever the end of the week passes;

a small day jumper that jumps and stops the small day indicator tooth portion of the small day indicator; and setting releasing means that releases a setting set by the second day jumper whenever the end of the week passes.

17. The retrograde display mechanism according to claim 16, wherein the setting releasing means releases the setting set by the small day jumper whenever the day transmitting wheel rotates by the amount corresponding one day.

18. The retrograde display mechanism according to claim 17 comprising a day jumper that jumps and stops the day transmitting wheel tooth portion, wherein the day jumper displaces the small day jumper so as to release the setting of the small day indicator tooth portion set by the small day jumper when the day transmitting wheel rotates by the amount corresponding to one day to pass a tooth of the day transmitting wheel tooth portion.

19. The retrograde display mechanism according to claim 17, wherein the small day jumper includes a day transmitting wheel engagement portion engaged with the day transmitting wheel tooth portion, and the small day jumper, when the day transmitting wheel tooth portion rotates by the amount corresponding to one day, is displaced by the day transmitting wheel engagement portion to release the setting of the small day indicator tooth portion.

20. A timepiece comprising the retrograde display mechanism according to claim 1.

* * * * *